US006871693B2

(12) United States Patent
Rahmfeld et al.

(10) Patent No.: US 6,871,693 B2
(45) Date of Patent: Mar. 29, 2005

(54) CONTINUOUS CASTING INSTALLATION COMPRISING A SOFT REDUCTION SECTION

(75) Inventors: Werner Rahmfeld, Mülheim a.d. Ruhr (DE); Jacob Wetter, Krefed-Hüls (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/362,252

(22) PCT Filed: Jul. 25, 2001

(86) PCT No.: PCT/EP01/08574

§ 371 (c)(1),
(2), (4) Date: Aug. 4, 2003

(87) PCT Pub. No.: WO02/18077

PCT Pub. Date: Mar. 7, 2002

(65) Prior Publication Data

US 2004/0026066 A1 Feb. 12, 2004

(30) Foreign Application Priority Data

Aug. 26, 2000 (DE) ..... 100 42 079

(51) Int. Cl.[7] ..... B22D 11/16

(52) U.S. Cl. ..... 164/452; 164/154.8; 164/417; 164/476

(58) Field of Search ..... 164/476, 452, 164/454, 154.8, 413, 417

(56) References Cited

U.S. PATENT DOCUMENTS 5,211,217 A 5/1993 Morii et al.

6,371,197 B2 * 4/2002 Weyer et al. ..... 164/454

FOREIGN PATENT DOCUMENTS

| | | |
|---|---|---|
| EP | 0776708 | 6/1997 |
| WO | 9850185 | 11/1998 |

OTHER PUBLICATIONS

Patent Abstracts of Japan, JP–04231104, Aug., 1992.
Patent Abstracts of Japan, JP–63242452, Oct., 1988.
Patent Abstracts of Japan, JP–63238965, Oct., 1998.
Patent Abstracts of Japan, JP–63278655, Nov., 1988.

* cited by examiner

*Primary Examiner*—Kuang Y. Lin
(74) *Attorney, Agent, or Firm*—Sidley Austin Brown & Wood, LLP

(57) ABSTRACT

The invention relates to a method and a device for the continuous casting of slabs or ingots, in particular of thin slabs in a continuous casting installation. Said installation comprises a soft reduction section in a continuous casting guide under the mould. The soft reduction section contains pressure rollers and support roller (3, 4), which are continuously restrained in relation to one another, either individually or as a segment (1), by means of hydraulic cylinders (7, 7') and are restrained in a limiting manner by stops (30). The installation uses a hard-pressure restraining force in an area of the soft reduction section that has not yet completely solidified and a soft-pressure restraining force in an area of the soft reduction section that has completely solidified. Threshold and changeover values for the hard and soft-pressure are defined in the segment is restrained using hard-pressure, such a way that if the restraining force lies below the threshold or changeover value, and if the restraining force lies above the threshold or changeover value the segment is restrained using soft-pressure.

11 Claims, 2 Drawing Sheets

CONTINUOUS CASTING INSTALLATION COMPRISING A SOFT REDUCTION SECTION

Figure 1:
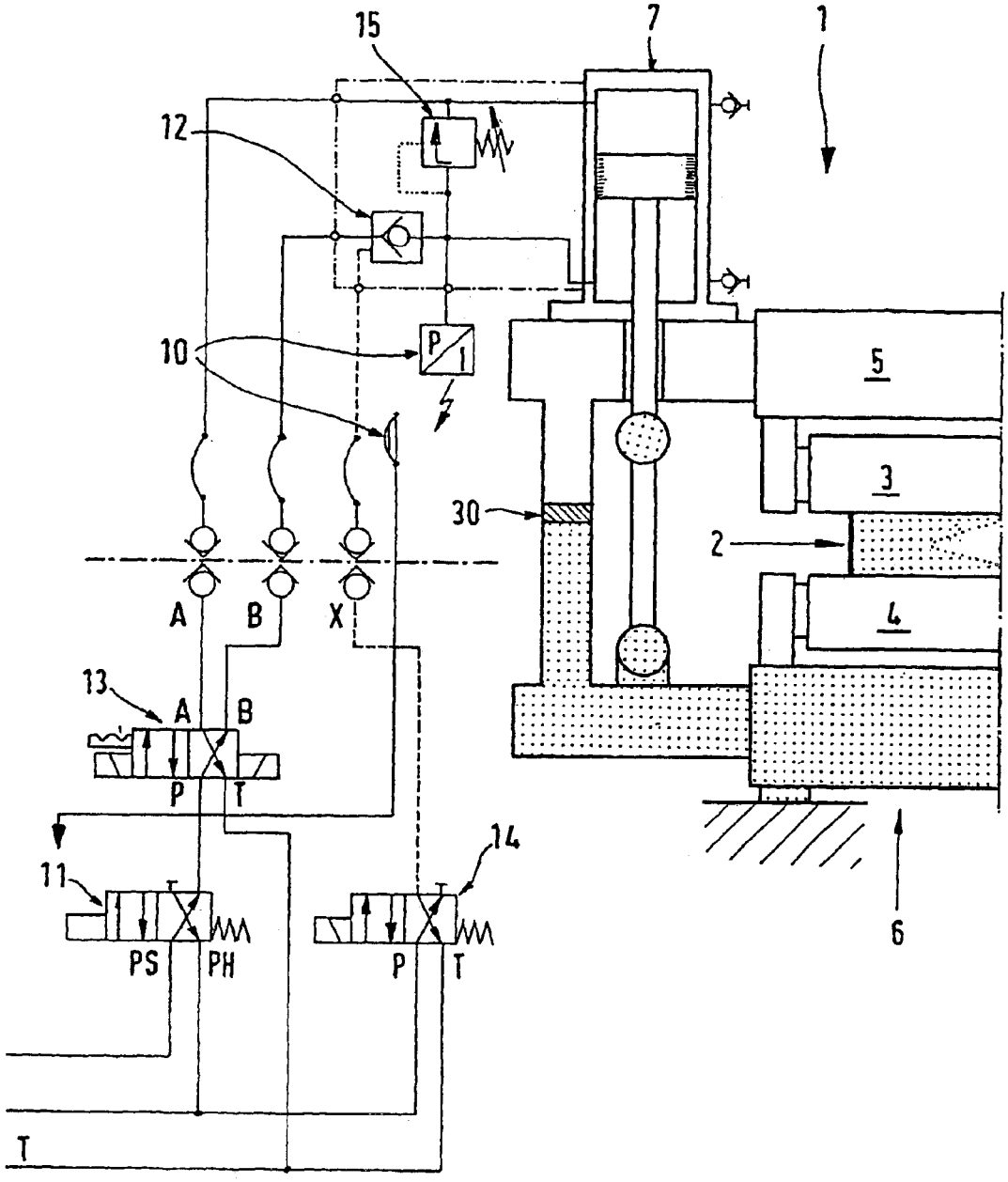

The invention relates to a method of an apparatus for continuous casting of slabs and ingots, in particular, of thin slabs in a continuous casting installation including a soft reduction section in a strand guide under a mold and having pressure rollers and support rollers which are continuously restrained relative to one another, either individually or as a segment by hydraulic cylinders, and are restrained by stops in a limiting manner.

Many presently operating continuous casting installations and continuous casting installations the operation of which is to begin, in particular, continuous casting installations for casting thin slabs use an operational technology with soft reduction. The method and a corresponding apparatus are primarily installed in the horizontal portion of a strand guide and serve for improving the microstructural quality and the surface quality of the cast products.

A soft reduction effect is achieved by a reduction of a strand thickness in the region of its solidification with a molten core up to the tip of a liquid crater. The region, in which the soft reduction significantly affects the strand inner quality lies in the solidification range at FS: 0.3 through 0.8 according to a longitudinal position on the solidification path. The soft reduction, which consists in reduction of the thickness in small steps in the above-mentioned region, prevents to a substantial extent segregation in the melt.

In order to achieve the soft reduction in a defined operational region at different operation conditions, which can be caused, e.g., by changes in the casting speed, or by stoppages, the zone, in which the strand thickness is reduced, should be changeable along the longitudinal position of the strand. To this end, a position controlled power cylinder is used in the support segments.

In order to effect a predetermined reduction of the thickness of a running strand, the support rollers are conically adjusted to a position favorable for soft reduction by determining the position of the crater and by determining, by calculations or by measurements, the change in the pressure applied to the pressure rollers by the strand. This method is practically completely developed and is designated as a dynamic soft reduction that, however, because of the used technical means, is connected with high costs.

An object of the invention, proceeding from the above-mentioned state of the art, is a method and an apparatus for casting slabs or ingots, in particular, thin slabs, which is recited in the preamble of claim 1 and which would make possible a highly effective soft reduction with reduced costs of the technical means and with a high quality of the results.

In order to achieve the above-mentioned object, according to the invention, hard-pressure restraining force is used in an area of the soft reduction section that has not yet completely solidified, and a soft-pressure restraining force is used in an area of the soft reduction section that has completely solidified, with a threshold or changeover value for the hard-pressure and the soft-pressure being defined and with a restraining force being below the threshold or changeover value, restraining of the segment is effected by using the hard-pressure, and above the threshold or changeover value, restraining of the segment is effected by using the soft pressure.

The inventive process is based on the knowledge obtained from a practical operation that a completely solidified section of a strand, in case it reaches the region of the soft reduction, should not be deformed as, otherwise, the support or pressure rollers, or their bearings, or the segment frame would be damaged, in particular when the sort reduction region is formed of several conically adjustable segments. Such a case can exist when the casting speed is changed and/or when the operation is interrupted. In such a case, the restraining force for the soft reduction must be able to change from the hard-pressure to the soft-pressure, amounting advantageously to 40% of the hard pressure in run-out section of the strand.

According to the invention, this changeover from the hard-pressure to the soft-pressure and, vice versa, if needed, takes place automatically as a result of sensing of a pressure increase pulse generated in the power cylinder upon entrance of a non-deformable, completely solidified strand in the conically adjusted segment and which is sensed by a pressure sensor.

According to one embodiment of the method, it is contemplated that at a running cast operation with the hard-pressure in the soft reduction section, upon reaching an upper threshold or changeover value of the restraining force, a changeover to the soft-pressure take place and, vice versa, at a running cast operation with the soft pressure in the soft reduction section, upon reaching a lower threshold or changeover value for the restraining force, a changeover to the hard-pressure takes place.

According to a further development of the inventive method, upon entry of a non-deformable, completely solidified strand section in a conically adjusted, for a hard pressure, segment, a changeover from a hard pressure to a soft pressure takes place, based on a resulting pressure increase pulse in the power cylinder.

The power cylinders are primarily subjected to a soft reduction pressure, a so-called hard-pressure, with each displacement of the piston resulting in a pressure change. A pressure sensor on the cylinder provides for the use of the pressure increase pulse, which is generated in the cylinder, as discussed above, when a non-deformable, completely solidified strand enters the conically adjusted seament for automatic switching to a soft-pressure. For practically effecting this, a shut-off valve is partially open by a relief valve so that a segment in the hydraulic switching circuit can give way, i.e., the segment inlet width changes so that the completely solidified strand section can pass through the segment at the soft-pressure.

According to a further embodiment of the inventive method, upon switching of a segment to an operation condition with a soft-pressure for a completely solidified strand section in the segment, a pressure inquiry is initiated wherein in short, cyclic, time intervals, changeover from the soft pressure to the hard pressure and vice versa takes place, and it is checked whether the pressures remain unchanged or whether they are above or below a respective threshold or changeover value and, dependent on a pressure test an a adjustment to the hard pressure or the soft-pressure takes place. These measures prevent a further opening of the segment by a ferrostatic pressure of the melt.

According to a still further embodiment of the inventive method, all segments in the soft reduction region and the segments behind them up to machine end are subjected to a cyclic pressure inquiry. Thereby, a uniform quality of a cast product is insured.

According to a preferred embodiment of the method, in particular in a horizontal portion of a continuous casting installation, a strand section, in which soft reduction conditions are true for an operation state of the casting operation and for used steel types, is determined. Then, in the determined strand support section, all support segments are individually adjusted with a necessary conicity in such a way that a running-through strand retains a necessary for the soft reduction, deformation.

To this end, the hydraulically adjustable support segments are individually adjusted, with respect to a thickness predetermined by a mechanical stop, to a given amount of soft reduction. The mechanical stops prevent the support rollers from approaching to close to each other and thereby any damage of the support structure.

An apparatus for continuous casting of slabs and ingots, in particular, of thin slabs in a continuous casting installation including a soft reduction section in a strand guide under a mold and having pressure rollers and support roller which are continuously restrained relative to one another, either individually or as a segment by hydraulic cylinders, and are restrained by stops in a limiting manner, includes a segment with support and pressure rollers adapted to a strand, driven with an adjustable speed, and arranged in a segment frame with frame upper part and frame lower part, and a hydraulic cylinder. According to the invention, a hydraulic circuit includes a pressure sensor and a pressure changeover valve operated by it, a shut-off valve arranged in its switching circuit, a control valve and a relief valve, means for preventing rupture of conduits and including a pressure relief valve with a check valve. The apparatus serves to provide a hard-pressure restraining force within the not yet completely solidified region of the soft reduction section or a soft-pressure restraining force within the completely solidified region of the soft reduction section and for switching from the hard pressure to the soft-pressure and vice versa. The restraining force is uniformly led into the pressure and support rollers from the hydraulic cylinder through the frame upper part and the frame lower part.

Figure 2:
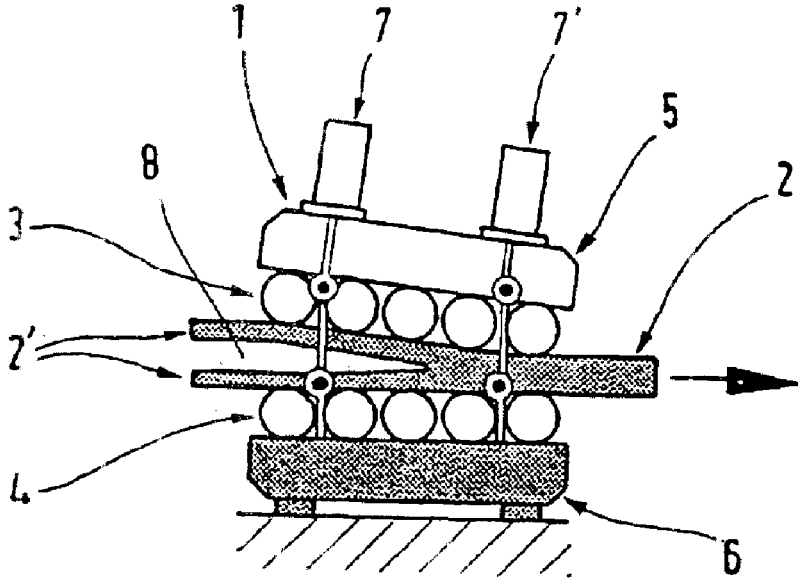

Further particularities, features, and advantages of the invention will become apparent from the following description of an embodiment of the invention shown schematically in the drawing. The drawings show:

FIG. 1 a section of a support segment for a cast strand, together with an associated circuit diagram for effecting the method according to the invention;

FIG. 2 a support segment in an open position for running in of a strand with a partially liquid core in the region of the tip of the crater.

FIG. 1 shows a section of a support segment 1 for a strand 2, e.g., of a thin slab cast in a continuous casting installation. The support segment is located within a soft reduction section of a strand guide and has pressure rollers 3 and support rollers 4 which are continuously restrained relative to one another, either individually or, in the case considered here, as a segment, with a hydraulic cylinder 7.

The numeral 30 designates a mechanical stop which defines a predetermined thickness and against which a segment lower part 6 can be individually adjusted relative a segment upper part 5 to an amount of soft reduction by pulling the piston rod of the cylinder 7.

In the soft reduction section, the thickness of the cast thin slab is reduced in small steps in order to prevent segregation within the strand and in order to improve the surface quality. The soft reduction section includes at least large elongate regions of the strand with molten core tip to the tip of the liquid crater. In order to adapt the adjustment of the support segments to a respective changing position of the crater tip, which is changed as a result of different operational conditions, a special hydraulic circuit is provided.

As shown in the circuit diagram of FIG. 1, the working pressure of the hydraulic circuit is tapped above and beneath the piston of the hydraulic cylinder 7 and is evaluated by a pressure sensor 10. The pressure sensor 10 on the cylinder 7 provides for use of the pressure increase pulse in the cylinder, e.g., for switching from hard-pressure to soft-pressure. To this end, the pressure sensor 10 is connected with a pressure changeover valve 11 by signal lines.

The power cylinder 7 is subjected to the action of, primarily, the soft reduction pressure, i.e., to the action of hard-pressure, and is connected, by a shut-off valve 12, e.g., conduit rupture-preventing valve or a pilot-controlled check valve, with a pressure relief valve 15 in such a way that each displacement of the piston results in a pressure change which, as it has already been mentioned above, in case of a pressure increase in the cylinder, is sensed by the pressure sensor and is used for switching to a soft pressure.

In case of soft pressure, on the other hand, the shut-off valve 12 is open by a relief valve 14, and the segment can give in, i.e., the segment inlet width can be changed, whereby the solidified strand 2 can pass through the segment 1 under soft pressure.

When at another point in time, a non-solidified strand region with a fluid crater reaches the segment 1, the segment 1 is subjected to an action of soft pressure and gives further in under the action of the ferrostatic pressure of the strand 2, opening even more, which is not acceptable and which causes a reduction in quality of the cast strand.

In order to prevent a further opening of the segment 1 under the ferrostatic pressure of the non-solidified strand 2, a pressure inquiry in initiated in the hydraulic circuit, at which in short time intervals with time pulses, the control valve 13 is switched, by the pressure sensor 10, from soft pressure to hard pressure, and the shut-off valve 12 is closed.

Finally, it is checked whether the hard-pressure remains constant, i.e., whether it remains under the changeover valve or exceeds it. If the pressure is below the changeover value, it means that the strand 2 has not yet completely solidified and a hard pressure is needed for restraining the segment.

When, however, the pressure exceeds the changeover value, it means that the strand 2 has completely solidified, and the segment restrain should be effected with soft pressure.

FIG. 2 shows a segment 1 in a position for running of the strand 2, with strand shells 2' not yet closed with a core 8 of liquid melt, in. The segment frames include the segment frame-upper part 5 and the segment frame-lower part 6 which are clamped together with a relatively large force against the action of the ferrostatic pressure of the strand shells 2' and the liquid molter core 8. The segment 1 is equipped with pressure guide rollers 3 and 4 which are partially provided with drives, as is known.

The hydraulic cylinder 7' is subjected to the action of the soft pressure, and the hydraulic cylinder 7 is subjected to the action of the hard-pressure, in accordance with the present invention.

What is claimed is:

1. A method of continuous casting of slabs and ingots, in particular, of thin slabs in a continuous casting installation including a soft reduction section in a strand guide under a mold and having pressure rollers and support rollers (3,4) which are continuously restrained relative to one another, either individually or as a segment (1) by hydraulic cylinders (7, 7'), and are restrained by stops (30) in a limiting manner, the method comprising the steps of using a hard-pressure restraining force in an area of the soft reduction section of the strand guide in which the strand has not completely solidified, and using a soft-pressure restraining force in an area of the soft reduction section of the strand guide in which the strand has completely solidified; defining a pressure changeover value at which restraining with the hard-pressure restraining force is switched to restraining with the soft-pressure retaining force and vice versa; and applying the soft pressure restraining force when the pressure is above the changeover value, and applying the hard-pressure retaining force when the pressure is below the changeover value.

2. A method according to claim 1, comprising the steps of changing the hard-pressure restraining force to the soft-pressure restraining force when an upper threshold of the restraining force is reached, and changing the soft-pressure restraining force to the hard-pressure restraining force when a lower threshold of the restraining force is reached.

3. A method according to claim 1, comprising the step of changing the hard-pressure restraining force to the low-pressure restraining force upon entry of a non-deformable, completely solidified strand section in a conically adjusted, for a hard pressure, segment, in response to a resulting pressure increase pulse in the power cylinder.

4. A method according to claim 1, comprising the steps of initiating, after switching of a segment to an operational conditional with a soft-pressure for a completely solidified strand section, in case of a following feeding of a non-completely solidified strand section in the segment, a pressure inquiry wherein in short, cyclic, time intervals, a changeover from the soft-pressure to the hard-pressure and vice versa takes place; checking whether the pressures remain unchanged or whether they are above or below a respective changeover value; and, dependent on a pressure test, effecting adjustment to the hard pressure or the soft pressure.

5. A method according to claim 4, comprising the step of subjecting to the pressure inquiry all of segments in the soft reduction regions and of all of the segments up to a casting machine end.

6. A method according to claim 1, comprising the step of determining, in a horizontal portion of the continuous casting installation, a strand section in which soft reduction conditions are true for an operational state of the casting operation and for used steel types.

7. A method according to claim 6, comprising the step of individually adjusting, with a necessary conicity, all support segments in a determined strand section support in such a way that a running-through strand retains a deformation necessary for soft reduction.

8. A method according to claim 1, comprising the step of individually adjusting the hydraulically adjustable support segments with respect to a thickness predetermined by a mechanical stop (30), to a redetermined amount of soft reduction.

9. A method according to claim 1, comprising the step of adjusting the soft pressure about between 30% and 50% of the hard pressure.

10. A method according to claim 9, wherein the soft pressure adjusting step includes adjusting the soft pressure to 40% of the hard pressure.

11. An apparatus for continuous casting of slabs and ingots in a continuous casting installation including a soft reduction section in a strand guide under a mold and having pressure rollers and support rollers (3,4) which are continuously restrained relative to one another, either individually or as a segment (1) by hydraulic cylinders (7,7'), with a change of the restraining pressure and are restrained by stops (30) in a limiting manner, the apparatus comprising: a hydraulic circuit including a pressure sensor (10) for determining pressure in the hydraulic circuit; a pressure changeover valve (11) controlled by the pressure sensor (10); a shut-off valve (12); a control valve (13) for controlling flow to the hydraulic cylinders (7, 7'); a relief valve (14) for controlling the shut-off valve (12); and a pressure relief valve (15) cooperating with the shut-off valve (12) for providing a hard pressure restraining force within one of a region of the soft reduction section in which the strand has not yet completely solidified, and a region of the soft reduction section in which the strand has completely solidified, and for switching from the hard pressure to the soft pressure and vice versa.

* * * * *